United States Patent [19]

Thorgersen et al.

[11] Patent Number: 4,900,605

[45] Date of Patent: Feb. 13, 1990

[54] BRISTLE PILE TEXTILE FOR GARMENT APPLICATIONS

[76] Inventors: Harold Thorgersen, 44 Heritage Dr., Woodbury, Conn. 06798; Fred Olsen, Biskop Grimelunds, v. 21, Oslo, Norway

[21] Appl. No.: 245,345

[22] Filed: Sep. 16, 1988

[51] Int. Cl.[4] ..... B32B 3/02

[52] U.S. Cl. ..... 428/88; 428/85; 428/224; 428/253

[58] Field of Search ..... 428/85, 88, 253, 224

[56] References Cited

U.S. PATENT DOCUMENTS

| | | | |
|---|---|---|---|
| 608,903 | 8/1898 | Pendergast . | |
| 1,519,878 | 12/1924 | Pugatsky et al. . | |
| 2,717,437 | 9/1955 | Mestral | 28/72 |
| 3,096,561 | 7/1963 | McNally | 28/72 |
| 3,423,764 | 1/1969 | Cassling | 2/337 |
| 3,539,436 | 11/1970 | Hamano | 161/89 |
| 3,895,489 | 7/1975 | Waller | 66/91 |
| 4,333,976 | 6/1982 | Ohomoto et al. | 428/85 |
| 4,656,073 | 4/1987 | Harris | 428/85 |

*Primary Examiner*—James J. Bell

*Attorney, Agent, or Firm*—William C. Crutcher

[57] ABSTRACT

An improved textile material having a bristle pile specially adapted for use on articles of clothing to create a preferential movement thereof, said improved material comprising a plurality of weft and/or warp yarns, and a pile yarn passing among said weft and/or warp yarns, at least one leg of each loop of said pile yarn being straight and extending at a preselected angle from the surface of said textile to provide a plurality of relatively rigid bristles, and means causing said pile bristles to maintain said preselected angle with the surface of the textile, whereby random movement of the textile with the bristles against the surface of an adjacent object will create a preferential movement of said textile with respect to said object.

8 Claims, 3 Drawing Sheets

BRISTLE PILE TEXTILE FOR GARMENT APPLICATIONS

BACKGROUND OF THE INVENTION

This invention relates generally to a special purpose textile and method of its manufacture, the textile being useful in certain applications for garments or clothing. More particularly, the invention relates to a bristle pile textile.

A well known problem with some articles of garments or clothing is that they tend to move on the body or against other articles of clothing toward an undesired position. For example, socks sag, sleeves work up the arm, and shirts and blouses gradually work out of trousers and skirts respectively at the waist.

I have observed that if a material or fabric is provided with slanted, relatively stiff bristles, there is a tendency for the textile or fabric to creep or move in a direction away from the slant of the bristles. This phenomenon can be seen by removing the bristled or bearded heads from some grasses. The slender awns are slanted on the grass heads and cause them to move through the fingers when lightly held.

Various techniques have been suggested to keep clothing in place. U.S. Pat. No. 3,423,764—Cassling describes a pad of Velcro (Registered Trademark of Velcro Corporation) attached to a Person's leg and having resilient hooks which will impale and attach themselves to the threads of a sock fabric.

U.S. Pat. No. 1,519,878—Pugatsky et al describes a special fabric for attachment to the inside of the waistband of trousers. The fabric comprises superposed layers of haircloth providing projections or darts which engage the shirt both frictionally and positively and prevent it from moving upwardly.

U.S. Pat. No. 608,903—Pendergast (1898) describes a belt with prongs or teeth adapted to engage with a shirt or other garment to prevent it from slipping. It would be desirable to provide a special bristled textile which would assist in keeping garments in place by using conventional methods of weaving or knitting to produce the textile. It is a well-known technique to make woven pile fabrics by weaving an extra set of warp or filling yarns. The pile yarns make loops which are cut after weaving and are usually soft and pressed during finishing so that the pile fibers lie against the textile facing in the same direction.

Various methods have been suggested in the prior art for Providing textiles with projecting tufts or barbs for various reasons. Exemplary of these are the following:

U.S. Pat. No. 3,845,641—Waller describes a method and apparatus for producing a knitted fabric with projecting barbs of a monofilament thread of a thermoplastic material.

U.S. Pat. No. 2,717,437—Mestral describes a woven pile fabric using a pile of synthetic resin material forming loops which are cut at one side to provide hooks.

U.S. Pat. No. 3,539,436—Hamano describes a knitted product having fixed pile loops of thermoplastic resin to provide a material - engaging surface of hooks.

U.S. Pat. No. 3,096,561—McNally describes a tufted pile fabric and method of making it including tufting a soft fluffy yarn to extend in a slanted direction.

It would be desirable to provide a bristle pile textile using conventional weaving or knitting techniques for holding garments in place.

Accordingly, one object of the present invention is to provide an improved bristle pile textile and method of making it.

Another object of the invention is to provide an improved textile for application with garments.

DRAWINGS

The invention, both as to organization and method of practice, together with further objects and advantages thereof, will best be understood by reference to following specification, taken in connection with the accompanying drawings, in which:

FIG. 1 is a simplified cross-sectional view of my improved bristle pile textile, FIG. 2 is a cross-section of the same textile cooperating with the surface of an adjacent object, FIG. 3 illustrates an application in socks, FIG. 4 illustrates an application in trousers, FIG. 5 is an enlarged cross-sectional view of one type of bristle pile fabric, FIG. 6 is a plan view of another type of woven bristle pile textile, FIG. 7 and FIG. 8 are cross-sectional views taken along lines. VII—VII and VIII—VIII, respectively of FIG. 6, FIG. 9 is an enlarged cross-section illustrating positioning of the bristle pile, FIG. 10 is a plan view of an alternate type of woven bristle pile textile, FIG. 11 is a cross-section taken along lines XI—XI of FIG. 10, and FIG. 12 is a cross-section taken along lines XII—XII of FIG. 10.

SUMMARY OF THE INVENTION

Briefly stated, the invention is practiced by providing an improved textile material having a bristle pile specially adapted for use on articles of clothing to create a preferential movement thereof, said improved material comprising a plurality of weft and/or warp yarns, and a pile yarn passing among said weft and/or warp yarns, at least one leg of each loop of said pile yarn being straight and extending at a preselected angle from the surface of said textile to provide a plurality of relatively rigid bristles, and means causing said pile bristles to maintain said preselected angle with the surface of the textile, whereby random movement of the textile with the bristles against the surface of an adjacent object will create a preferential movement of said textile with respect to said object.

DESCRIPTION OF THE PREFERRED EMBODIMENT

Figure 1:
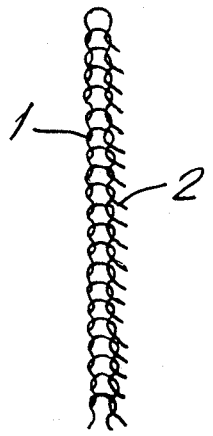

Referring to FIG. 1 of the drawing an improved bristle pile textile is shown in cross section, comprising a woven or knitted textile material 1 having a plurality of straight bristles 2 extending at an angle from the surface thereof. The bristles are preferably more rigid than the warp and/or weft yarns making up the base fabric itself.

Figure 2:
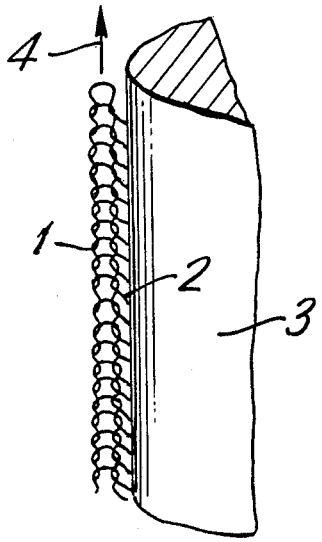

FIG. 2 of the drawing illustrates the same textile placed with the bristles against the surface of an adjacent object 3. Random movement of the textile material toward, away from, laterally and longitudinally with respect to the object 3 causes a preferential movement of textile 1 in a direction away from that of the extending bristles 2, as indicated by arrow 4.

Figure 3:
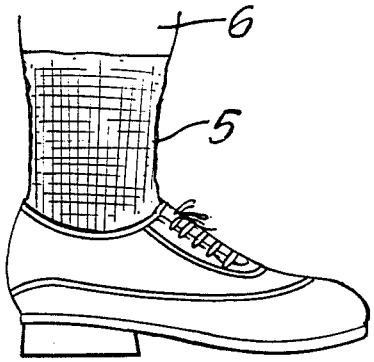

One preferred use of the improved textile material is shown in FIG. 3, where a sock 5 of knitted material is provided with bristles on the inside, slanted downward against leg 6. The bristles 2 are preferably provided by a knitting operation which creates bristles 2 in a manner to be described.

Figure 4:
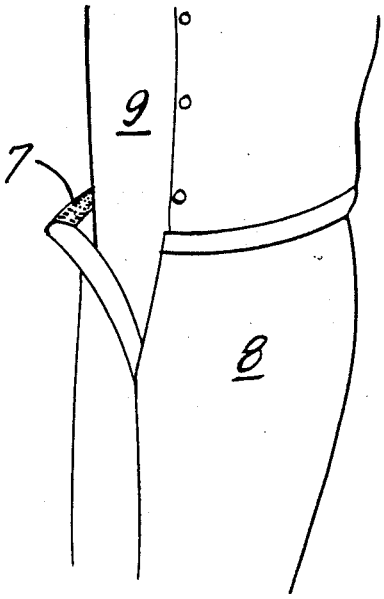

FIG. 4 illustrates the improved textile material attached in a strip 7 on the inside of the waistband of trousers 8, with bristles slanted downward, so that the textile material 7 will come in contact with shirt 9. Obviously, for women's apparel a similar strip 7 of improved textile material could be provided in the waistband of a skirt to contact a blouse.

Figure 5:
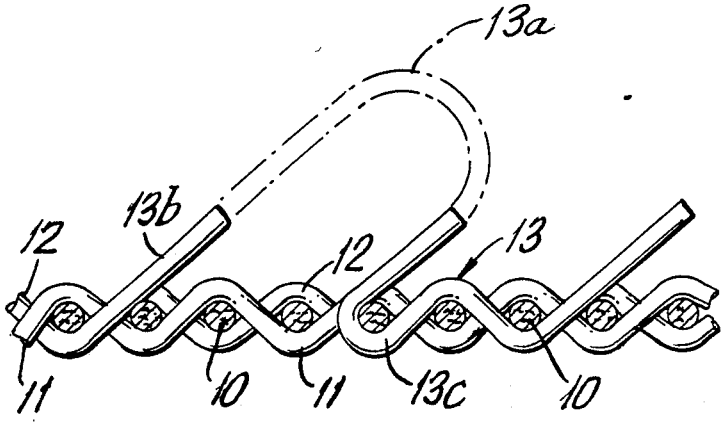

FIG. 5 illustrates the invention in very general form for a woven material. A textile comprises a plurality of warp yarns 10 and plurality of weft yarns 11, 12.

Interwoven among the weft and warp yarns is a relatively rigid pile thread 13. In the case of FIG. 5, pile 13 is preferably formed of a synthetic resin material or thermoplastic material which will allow it to be cured by heat to a rigid shape. A material such as nylon may be used for pile 13. During the course of manufacture, the ends of the loops, shown in phantom lines 13*a*, are removed to leave a plurality of straight bristles 13*b* extending at an angle with respect to the surface of the textile. This angle is preferably on the order of 45 degrees. The length of the bristles 13*b* is preferably on the order of one to three millimeters, but depends to a large degree upon the bristle diameter, material and particular application. Where the bristle will be in contact with the human skin, a less rigid, longer, and more slender bristle would be employed. When the thermoplastic resin is cured, the portion 13*c* of the thread will serve to maintain the bristle at the preselected angle.

Bristles may also be provided in knitted material using a technique such as that described in U.S. Pat. No. 3,895,489, which is incorporated herein by reference. This patent describes either a wale knitted or a course knitted fabric with a monofilament pile thread knitted into the base fabric. However, contrary to the final step of the aforesaid patent wherein the "barbs" are set perpendicular to the surface of the fabric, my invention contemplates setting of the thermoplastic filaments at preselected angles with respect to the fabric surface, somewhere between 30 degrees and 60 degrees, but preferably around 45 degrees.

Figure 6:
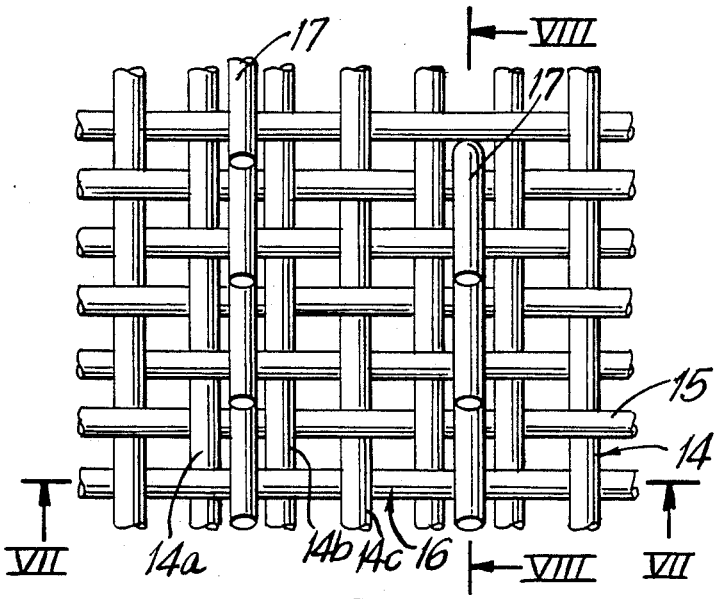
Figure 7:
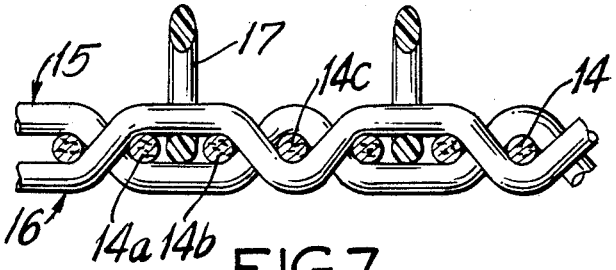
Figure 8:
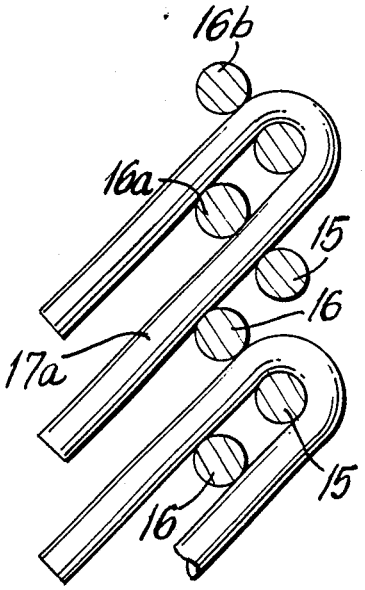

FIGS. 6–8 illustrate another form of the invention in a woven material. A plurality of weft yarns 14 are interwoven with warp yarns 15, 16 in a pattern which alternates between two wefts 14*a*, 14*b*, and one weft 14*c*. This leaves a space between two adjacent weft yarns 14*a*, 14*b*, through which is interwoven a relatively rigid pile yarn 17. As illustrated in FIG. 8, this type of weaving creates alternating upper and lower layers of the warps 15, 16 at the position of the pile yarn 17. In this manner, a given bristle 17*a* is directed at an angle between a particular lower warp 15*a* and upper warp 16*a* and is further supported by an upper warp 16*b*. This provides means of holding the bristle 17*a* at a preselected angle.

Figure 9:
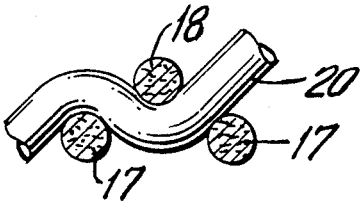

As illustrated in FIG. 9, suitable tensioning and positioning of the warp threads 17, 18, 19, so that the pile yarn 20 forming a bristle exits along a line perpendicular to a line drawn through the centers of yarns 18, 19 will serve as a means to hold a relatively rigid yarn at a preselected angle, even though it may not consist of thermoplastic material.

Figure 10:
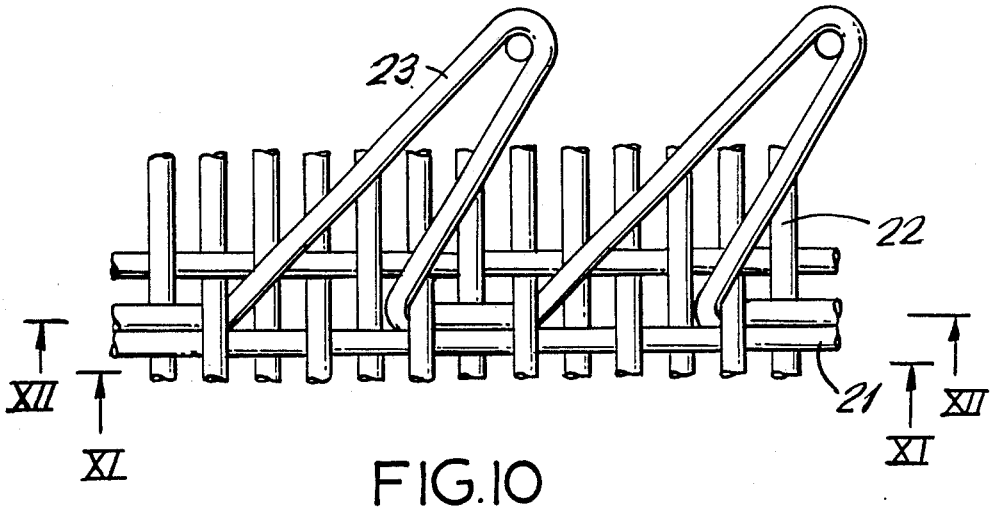
Figure 11:
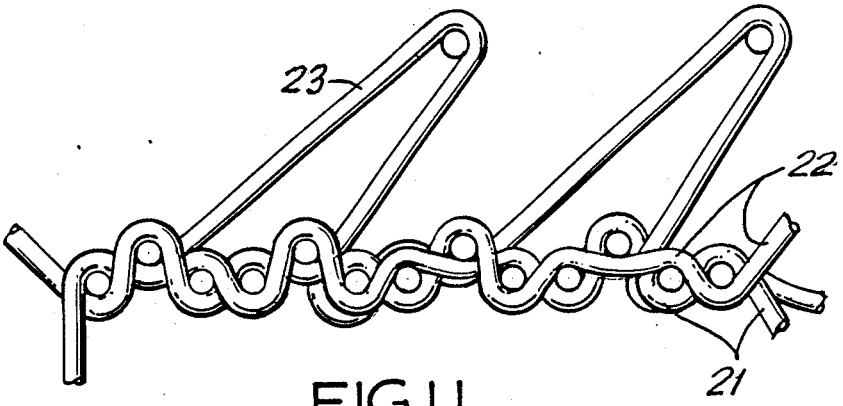
Figure 12:
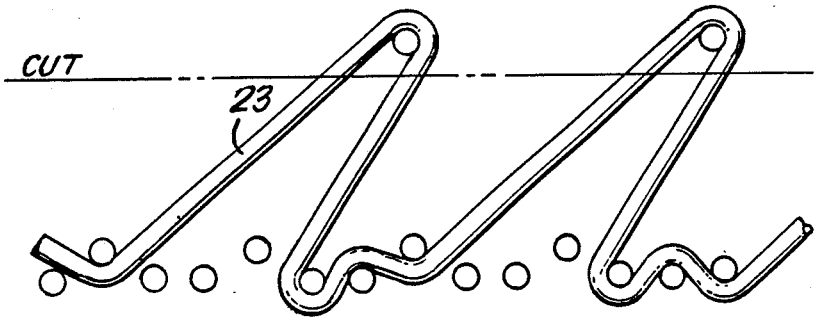

Reference to FIGS. 10, 11, and 12 shows yet another form of the invention in a woven material. Here a normal weave is provided by the alternating warps 21 and wefts 22. A pile fabric 23 (see FIG. 12) is woven among the warp and weft yarns, which have been positioned as shown in FIG. 11 by appropriate tension on the warp and weft during the weaving process. The loops 23 are drawn and cut as indicated in FIG. 12 to form relatively rigid straight bristles extending from it and held at two slightly different preselected angles to the surface of the material.

While there has been described what is considered to be the preferred embodiment of the invention of an improved bristle pile textile and a new and useful use thereof, it is desired to cover in the appended claims all such modifications as fall within the true spirit and scope of the invention.

We claim:

1. An improved bristle pile textile for application in articles of clothing for causing preferential movement thereof, said textile comprising a woven fabric having a plurality of weft and/or warp yarns and having a pile yarn providing a plurality of straight relatively rigid bristles extending at a preselected acute angle with respect to the surface of said textile, and retaining means causing said bristles to retain said preselected angle.

2. The combination according to claim 1, wherein said pile yarn comprises a synthetic thermoplastic resin material cured so that said bristles are held at said preselected acute angle by a thermosetting process, whereby said retaining means comprises a cured pile yarn portion woven among said weft and/or warp yarns.

3. The combination according to claim 1, wherein said textile comprises a woven fabric and, wherein said retaining means comprises upper and lower warp yarns held at a preselected position with respect to one another and oriented with respect to said pile yarn so as to guide the bristle along said preselected acute angle.

4. The combination according to claim 5, wherein said pile yarn comprises cured thermoplastic thread passing among first and/or second yarns of said bristle pile textile.

5. An improved bristle pile textile for application in articles of clothing for causing preferential movement thereof, said textile material comprising a plurality of first yarns, a plurality of second yarns, interwoven among said first yarns and a pile yarn interwoven among said first and second yarns, at least one leg of each loop of said pile yarn extending substantially parallel to adjacent legs at a preselected angle between 30 and 60 degrees from the surface of said textile and adapted to provide a relatively rigid straight bristle, and means causing said bristles to retain said preselected angle.

6. The combination according to claim 5, wherein said retaining means comprises tensioned first and second yarns.

7. An improved bristle pile textile for application in articles of clothing for causing preferential movement thereof, said textile comprising knitted fabric having a plurality of wale and/or course yarns and having a pile yarn providing a plurality of straight relatively rigid bristles extending at a preselected acute angle with respect to the surface of said textile, and retaining means causing said bristles to retain said preselected angle.

8. The combination according to claim 7, wherein said pile yarn comprises a synthetic thermoplastic resin material cured so that said bristles are held at said preselected acute angle by a thermosetting process, whereby said retaining means comprises a cured pile yarn portion woven among said wale and/or course yarns.

* * * * *